US006840267B1

(12) United States Patent
Jennings et al.

(10) Patent No.: US 6,840,267 B1
(45) Date of Patent: Jan. 11, 2005

(54) CONNECTION KIT FOR A BATH SPOUT

(75) Inventors: John P. Jennings, Aston, PA (US); Jeffery Tzeng, Taipei (TW); Alexander Yeh, Chang Hua Hsien (TW)

(73) Assignee: NCH Corporation, Irving, TX (US)

( * ) Notice: Subject to any disclaimer, the term of this patent is extended or adjusted under 35 U.S.C. 154(b) by 0 days.

(21) Appl. No.: 10/607,637

(22) Filed: Jun. 27, 2003

(51) Int. Cl.[7] ..... F16L 5/00; B67D 5/37
(52) U.S. Cl. ..... 137/360; 137/601; 4/678
(58) Field of Search ..... 137/360, 801; 4/678

(56) References Cited

U.S. PATENT DOCUMENTS

| | | | | |
|---|---|---|---|---|
| 1,273,859 | A | | 7/1918 | Hochberger |
| 1,562,982 | A | | 11/1925 | Muend |
| 3,136,570 | A | | 6/1964 | Lee |
| 3,188,120 | A | | 6/1965 | Peterson |
| 3,371,679 | A | | 3/1968 | Minella |
| 3,576,197 | A | * | 4/1971 | Bastian ..... 137/359 |
| 3,640,305 | A | | 2/1972 | Young |
| 3,739,806 | A | | 6/1973 | Bucknell et al. |
| 3,913,605 | A | | 10/1975 | Ward |
| 4,084,620 | A | | 4/1978 | Bucknell et al. |
| 4,117,858 | A | | 10/1978 | Bucknell et al. |
| 4,171,005 | A | | 10/1979 | Nicklas |
| 4,706,702 | A | | 11/1987 | Grasseschi |
| 6,175,972 | B1 | | 1/2001 | Wales |
| 6,195,818 | B1 | * | 3/2001 | Rodstein et al. ..... 4/678 |
| 6,267,145 | B1 | * | 7/2001 | Sun ..... 137/801 |
| 6,301,727 | B1 | | 10/2001 | Bertrand et al. |

* cited by examiner

*Primary Examiner*—A. Michael Chambers
(74) *Attorney, Agent, or Firm*—Locke Liddell & Sapp LLP; Monty L. Ross

(57) ABSTRACT

A universal connection kit for installing a bath spout having an internal coupling at the discharge end to a wall pipe. The connection kit is made up of a conduit and a number of adapters for connection to varying types of wall pipe. The components are connected together via corresponding threaded sections. The particular adapter used depends upon the type of wall pipe present since each adapter allows connection to one of the common types of wall pipe. The universal connection kit provides a flush fit of the bath spout against the wall, regardless of which adapter is used, if any.

49 Claims, 4 Drawing Sheets

CONNECTION KIT FOR A BATH SPOUT

BACKGROUND OF THE INVENTION

1. Field of the Invention

This invention relates generally to a kit useful for connecting a bathtub spout to a wall pipe and, more particularly, to a kit for connecting a bath spout to a variety of wall pipes with a flush fit of the bath spout against the wall.

2. Description of Related Art

Many structures have been disclosed for connecting a bathtub spout to a wall pipe. Examples include those described in U.S. Pat. No. 1,273,859; U.S. Pat. No. 1,562,982; U.S. Pat. No. 3,913,605; U.S. Pat. No. 4,084,620; U.S. Pat. No. 4,117,858; U.S. Pat. No. 4,171,005; U.S. Pat. No. 4,706,702; and U.S. Pat. No. 6,301,727. A number of structures have also been designed specifically to provide a flush fit between the bath spout shell and the wall. Examples of flush mount connections include those described in U.S. Pat. No. 3,136,570; U.S. Pat. No. 3,188,120; U.S. Pat. No. 3,371,679; U.S. Pat. No. 3,640,305; U.S. Pat. No. 3,739,806; and U.S. Pat. No. 6,175,972.

SUMMARY OF THE INVENTION

The present invention is a universal connection kit for attaching a bath spout having an internal coupling at the discharge end to a wall pipe. The connection kit principally includes a conduit and a number of adapters for connection to varying types of wall pipe. The components are connectable via corresponding threaded sections. The particular adapter used depends upon the type of wall pipe present because each adapter facilitates connection to one of the common types of wall pipe. The universal connection kit provides a flush fit of the bath spout against the wall, regardless of which adapter, if any, is used. Preferably there is at least one adapter for connecting to a threaded wall pipe and at least one adapter for connecting to a wall pipe that does not have any threaded section at its end, e.g., a slip fit adapter. In addition, the connection kit may preferably have a plurality of conduits of different lengths to further accommodate wall pipes of varying lengths.

BRIEF DESCRIPTION OF THE DRAWINGS

Various preferred embodiments of the current invention are further described and explained in relation to the following figures wherein.

DETAILED DESCRIPTION OF THE PREFERRED EMBODIMENT

The preferred embodiments of the connection kit of the current invention comprise a plurality of interconnectable conduits and adapters. The various parts of the connection kit can be made of any material that is appropriate for carrying fluid from the wall pipe to the discharge end of a bath spout shell. Preferably the connection kit parts are composed of a metallic or polymeric material.

Figure 1:
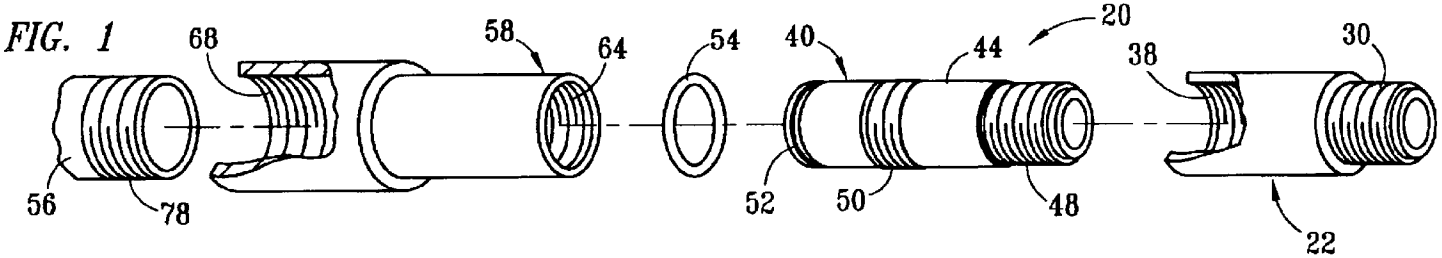
FIG. 1 is an exploded view showing the alternate connections of a first preferred embodiment using a first adapter and using a second conduit section of a first length.
Figure 2:
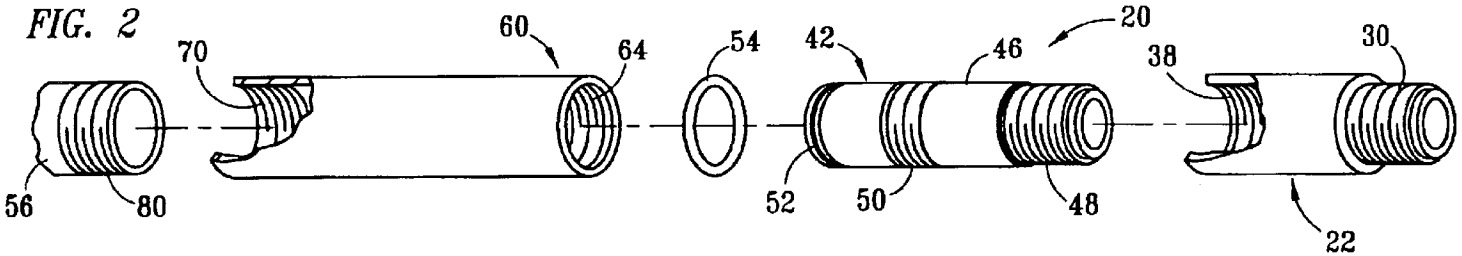
FIG. 2 is an exploded view showing the alternate connections of the first preferred embodiment using a second adapter and using a second conduit section of a second length.
Figure 3:
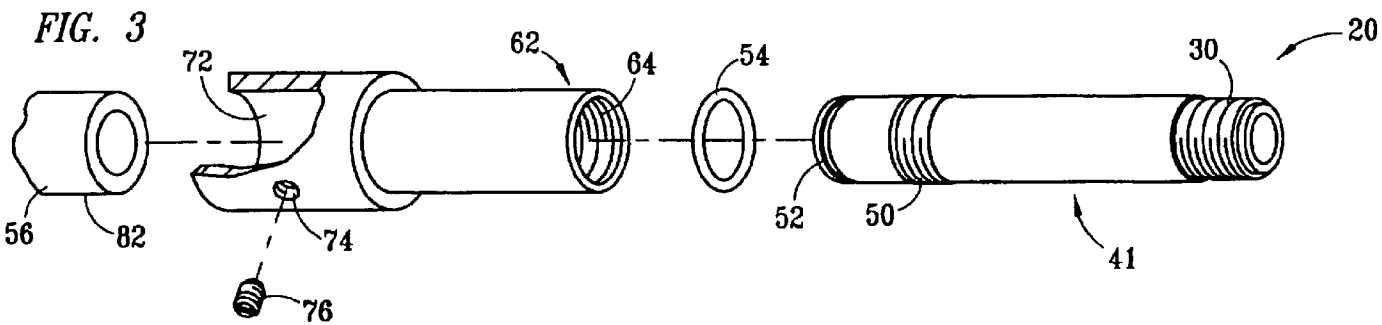
FIG. 3 is an exploded view showing the alternate connections of the first preferred embodiment using a third adapter and using a single conduit section.
Figure 4:
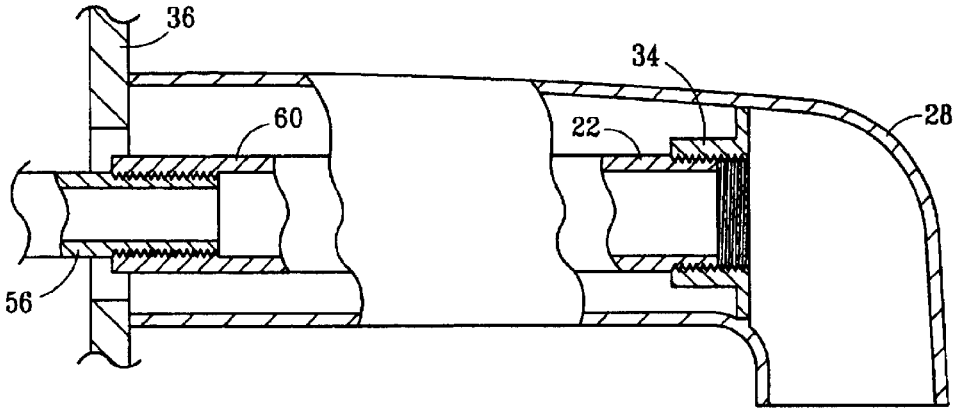
FIG. 4 is a partially cut away elevation view of the first preferred embodiment of the current invention used to install a bath spout shell to a wall pipe.

Referring to first preferred embodiment shown in FIGS. 1 through 4, connection kit 20 comprises first conduit 22, second conduits 40 and 42, which are a variety of fixed lengths, and adapters 58, 60 and 62 for securing connection kit 20 to various types of wall pipes 56. As shown generally in FIG. 4, connection kit 20 is used to connect standard bath spout shell 28 that has internal coupling 34 at its discharge end to wall pipe 56 that protrudes past wall 36. One of adapters 58, 60, and 62 is selected depending upon the type of wall pipe 56 that is present and one of second conduits 40 and 42 is selected depending upon how far wall pipe 56 protrudes beyond wall 36. Referring to FIGS. 1–3, male thread section 30 is located at one end of first conduit 22 to connect to internal coupling 34 of bath spout shell 28. Female thread section 38 is located at the opposite end of first conduit 22 and connects first conduit 22 to either second conduit 40 as shown in FIG. 1 or second conduit 42 as shown in FIG. 2.

Second conduits 40 and 42 differ only in the length of shanks 44 and 46 respectively. Either second conduit 40 or second conduit 42 is used, based upon how far wall pipe 56 protrudes past wall 36, to ensure that bath spout shell 28 is mounted flush against wall 36. Additional second conduits that have shank lengths different from shanks 44 and 46 can also be included in kit 20, in order to accommodate additional possible lengths of wall pipe 56. Alternatively, connection kit 20 can comprise a plurality of conduits that are each of a length equal that of first conduit 22 combined with one of second conduits 40 or 42. This is depicted in FIG. 3 where conduit 41 has a length equal to the overall-length of first conduit 22 and second conduit 40 threaded together. This provides a connection kit 20 with fewer connections that have to be made by the user, while still providing the variability in the overall length of connection kit 20 to accommodate wall pipes 56 that protrude to varying lengths beyond wall 36.

Second conduits 40 and 42 each contain a male thread section 48 at one end that can engage female thread section 38 on first conduit 22. Groove 52 is located at the other end of second conduits 40 and 42, as well as conduit 41. Sealing member 54 is located within groove 52 to help provide intentionally different seal between conduit 40, 41, or 42 and adapter 58, 60 or 62. Sealing member 54 is preferably an O-ring that is made of an elastomeric or other polymeric material. Additional sealing members can be included between the other conduit sections, if desired, to help provide a intentionally different seal between the pieces of connection kit 20, as well as between connection kit 20 and wall pipe 56 and bath spout shell 28. Second male thread section 50 is located proximal to groove 52 at the second end of conduits 40, 41, and 42 to provide a connection to one of adapters 58, 60 and 62.

There are preferably at least three adapters in connection kit 20, namely large thread adapter 58, small thread adapter 60, and slip fit adapter 62. Each of adapters 58, 60, and 62 has female thread section 64 on one end that fits over sealing member 54 and threadedly engages with second male thread section 50 on conduit 40, 41, or 42. In doing so, sealing member 54 is compressed between conduit 40, 41, or 42 and adapter 58, 60 or 62, thereby providing a liquid proof seal between the two segments. Adapters 58, 60, and 62 are preferably all of an identical length so that the overall length of connection kit 20 is dependent only upon whether second conduit 40, or 42 is used or the length of conduit 41. In this way, the use of either second conduit 40 or 42, or conduit 41 of a particular length, depends solely upon the distance that wall pipe 56 protrudes past wall 36, and not upon whether adapter 58, 60, or 62 is being used.

Adapters 58,60, and 62 are each designed to accommodate connection to a different type of wall pipe 56. Referring to FIG. 1, large thread adapter 58 contains a large female thread section 68 at the opposite end from female thread section 64. Large female thread section 68 is preferably standard ¾" female threads in order to thread to the ¾" standard male threads that make up male thread section 78 on wall pipe 56. Referring to FIG. 2, small threaded adapter 60 contains small female thread section 70 at the end opposite from female thread section 64. Small female thread section 70 is preferably standard ½" female threads in order to thread to the standard ½" male threads that make up male thread section 80 on wall pipe 56. Referring to FIG. 3, slip fit adapter 62 contains smooth internal bore 72 at the end oppose from female thread section 64. Smooth internal bore 72 slides over smooth external surface 82 on wall pipe 56. Locking screw 76 threads through screw hole 74 and frictionally engages smooth outer surface 82 to hold slip fit adapter 62 on wall pipe 56.

A sealing member (not shown) such as a standard O-ring can be located within a radial groove (not shown) in smooth internal bore 72 that is similar to groove 52 in conduits 40, 41, and 42. This helps provide a liquid seal between slip fit adapter 62 and wall pipe 56 in a manner similar to sealing member 54.

Connection kit 20 can be used to attach bath spout shell 28 flush against wall 36 regardless of the type of wall pipe 56 that is present by using adapters 58, 60 or 62. By using conduits 40 and 42, connection kit 20 also can accommodate a flush fit of bath spout shell 28 regardless of the distance wall pipe 56 protrudes beyond wall 36.

Figure 5:
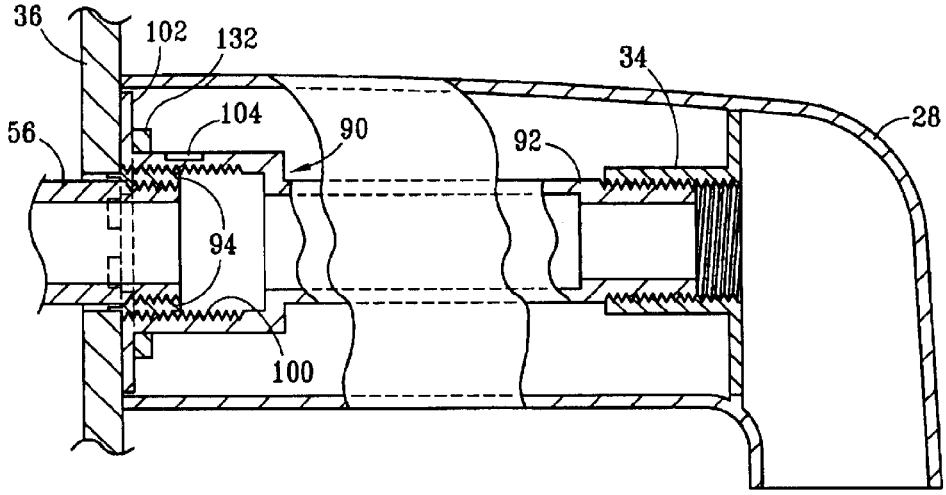
FIG. 5 is a partially cut away elevation view of a second preferred embodiment of the current invention used to install a bath spout shell to a wall pipe.

A second preferred embodiment is shown in FIGS. 5 through 9, where connection kit 90 comprises conduit 92 and adapters 94 and 96 for securing bath spout shell 28 to a variety of wall pipes 56. As shown in FIG. 5, connection kit 90 is used in conjunction with standard bath spout shell 28 that has internal coupling 34 near the discharge end of shell 28 and wall pipe 56 that protrudes past wall 36. If conduit 92 cannot directly connect to wall pipe 56, then one of adapters 94 and 96 is selected depending upon the type of wall pipe 56 that is present. Adapters 94 and 96 do not extend beyond the overall length of conduit 92, so conduit 92 does not have to be shortened to ensure a flush fit of bath spout shell 28 against wall 36.

Figure 7:
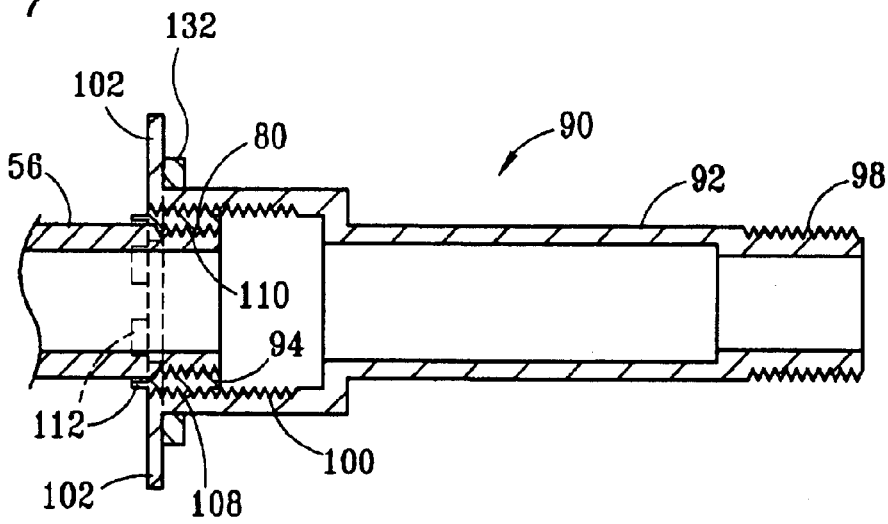
FIG. 7 is a cross section view showing the second preferred embodiment of the current invention using a first adapter and with a conduit that does not have either a hole or a recess.
Figure 8:
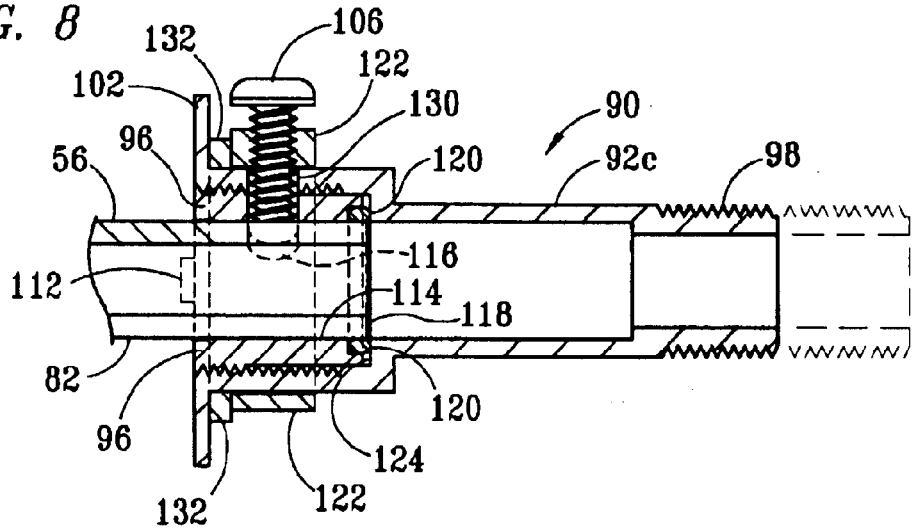
FIG. 8 is a cross section view showing the second preferred embodiment of the current invention using a second adapter and a conduit of a second length.
Figure 9:
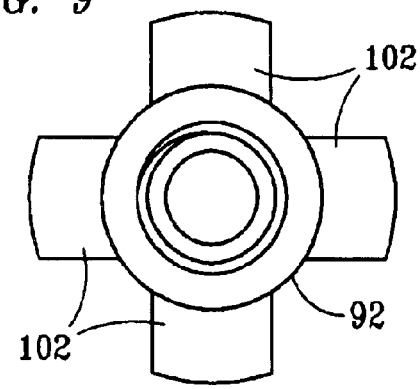
FIG. 9 is a side elevation view of the wall end of the conduit of the second preferred embodiment of the current invention.
Figure 10:
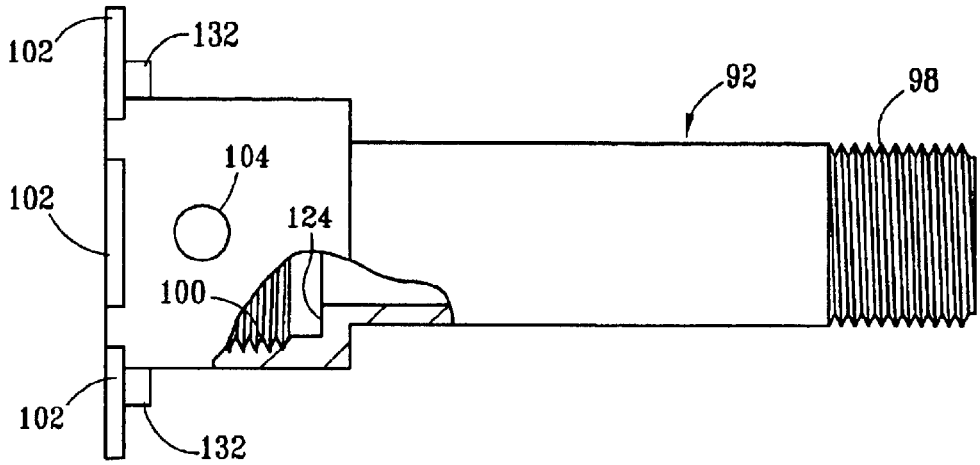
FIG. 10 is a partially broken away top plan view of the conduit of the second preferred embodiment of the current invention.

Referring to FIGS. 6–8 and 10, male thread section 98 is located at one end of conduit 92 to connect to internal coupling 34 of bath spout shell 28. Male thread section 98 is preferably standard ½" threading. Female thread section 100 is located at the opposite end of conduit 92 from male thread section 98 and connects conduit 92 to either wall pipe 56 or to one of adapters 94 or 96, depending upon the type of wall pipe 56 present. Female thread section 100 is preferably standard ¾" female threading. As can be seen in FIGS. 9 and 10, fins 102 are located at the same end of conduit 92 as female thread section 100. Fins 102 make easier to thread male thread section 98 into internal coupling 34 of bath spout shell 28, without the use of tools.

Figure 6:
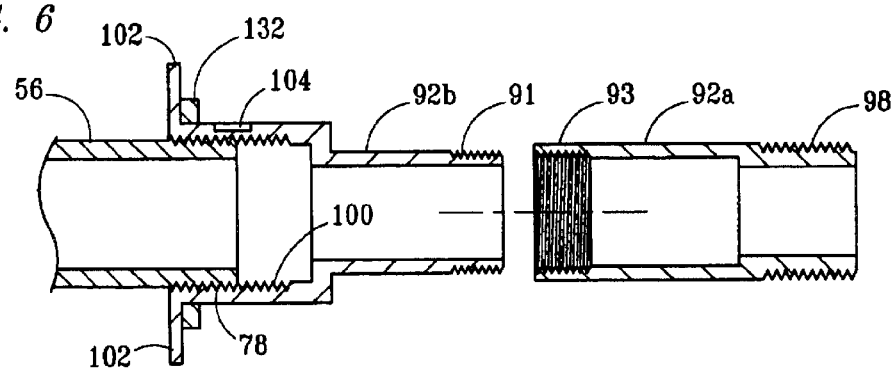
FIG. 6 is a cross section view showing the second preferred embodiment of the current invention using no adapter and showing the conduit composed of multiple threaded together conduit sections.

Conduit 92 can also be formed in multiple sections that are threaded together, as shown in FIG. 6. Conduits 92*a* and 92*b* thread together using thread segments 93 and 91 to form conduit 92. Also, conduit 92 can be of varying lengths, as shown by 92*c* in FIG. 8. Kit 90 can include multiple conduits 92, with each one having a different length. Conduit 92 of the appropriate length is then selected as a result of how far pipe 56 protrudes past wall 36. In this way kit 90 can accommodate wall pipes 56 that protrude past wall 36 by various amounts.

Recess 104 is also located near thread section 100 of conduit 92. Recess 104 passes partially through conduit 92. When adapter 96 is required, the user can punch recess 104 through the remainder of conduit 92 to form hole 130 as shown in FIG. 8, allowing setscrew 106 to pass through conduit 92. Alternately, multiple conduits 92 can be included in connection kit 90, one with hole 130 through conduit 92 for use with adapter 96, as shown in FIG. 8, and another without either hole 130 or recess 104 for use when adapter 96 is not required, as shown in FIG. 7. Preferably, if multiple conduits 92 are used, second adapter 96 is secured into female thread section 100 of the conduit 92 that contains hole 130, to ensure a tight seal between second adapter 96 and conduit 92. This can be accomplished in a number of ways, including but not limited to, using adhesives, integrally forming conduit 92 and adapter 96 as a single piece, and by mechanically tightening second adapter 96 into conduit 92.

Figure 11:
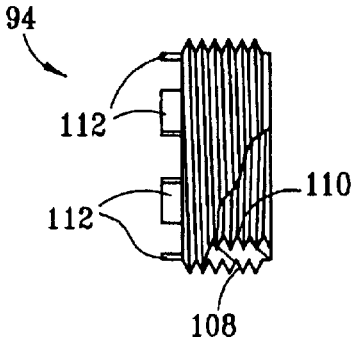
FIG. 11 is a partially broken away top plan view of the first adapter of the second preferred embodiment of the current invention.
Figure 12:
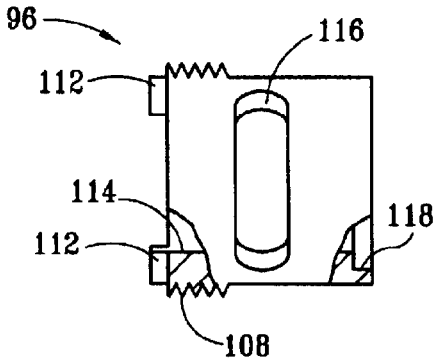
FIG. 12 is a partially broken away top plan view of the second adapter of the second preferred embodiment of the current invention.

As shown in FIG. 6, when the end of wall pipe 56 contains male thread section 78, neither adapter 94 or adapter 96 is required because female thread section 100 engages directly with male thread section 78 on wall pipe 56. As shown in FIGS. 5, 7 and 8, adapters 94 and 96 are each designed to accommodate connection to a different type of wall pipe 56. As shown in FIGS. 11 and 12, adapters 94 and 96 both have male thread section 108 on their exterior that engage with female thread section 100 on conduit 92. Adapter 94 is used when the end of wall pipe 56 contains male thread section 80. Adapter 96 is used when the end of wall pipe 56 contains smooth outer surface 82. In this manner, connection kit 90 can connect bath spout shell 28 to all of the common types of wall pipes 56.

Referring to FIGS. 7 and 11, adapter 94 is a reducing bushing that has male thread section 108 on its exterior surface and female thread section 110 on its interior. Adapter 94 is fully threaded to female thread section 100 in conduit 92. Tabs 112 are positioned along the edge of adapter 94 to assist in threading adapter 94 into conduit 92 until the edge of adapter 94 is flush with the edge of conduit 92. When fully threaded into conduit 92, tabs 112 still protrudes out of conduit 92, however, tabs 112 are not considered to increase the overall length of conduit 92. Female thread 1P section 110 is preferably standard ½" female threading that can mate with male thread section 80 on wall pipe 56. Since adapter 94 does not extend past the end of conduit 92, it can attach wall pipe 56 to conduit 92 without lengthening the distance between wall 36 and internal coupling 34 of bath spout shell 28, thereby providing bath spout shell 28 with a flush fit against wall 36.

Referring to FIGS. 8 and 12, adapter 96 is similar to adapter 94, but with a couple of notable differences. Male thread section 108 does not extend along the entire length of adapter 96. Also smooth bore 114 is located on the interior of adapter 96 instead of female thread section 110. As shown in FIG. 8, smooth bore 114 contacts and slides over smooth outer surface 82 on wall pipe 56. Adapter 96 also contains slot 116, which extends radially around adapter 96 and allows setscrew 106 to pass through adapter 96 and frictionally engage smooth outer surface 82 on wall pipe 56, in order to secure conduit 92 to wall pipe 56. Slot 116 preferably extends approximately 120° around adapter 96, so that a portion of slot 116 is aligned with hole 104 when adapter 96 is fully threaded into conduit 92. Finally, groove 118 is located in the end of adapter 96 opposite from tabs 112 and is shaped to hold sealing member 120. Preferably, sealing member 120 partially overhangs the end of adapter 96 as well as partially overhanging smooth bore 114 on the interior of adapter 96 in order to engage both smooth outer surface 82 and shoulder 124. In this way sealing member 120 ensures a liquid tight seal between adapter 96 and both wall pipe 56 and conduit 92. Sealing member 120 is preferably an O-ring that is made of either an elastomer or polymeric material.

Figure 13:
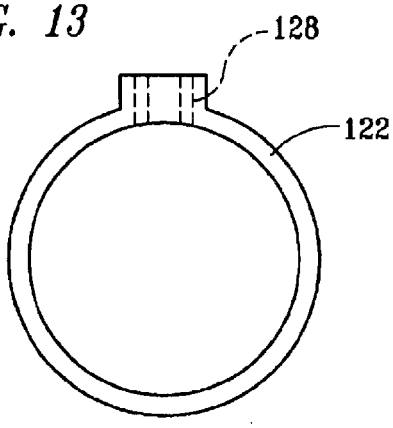
FIG. 13 is a front elevation view of clamp 122 of FIG. 8.

Adapter 96 is used in conjunction with clamp 122 also shown in FIG. 13, and setscrew 106 to secure conduit 92 to wall pipe 56 that has smooth outer surface 82. First, adapter 96 is fully threaded into conduit 92, with the aid of tabs 112, so that male thread section 108 engages female thread section 100. As a result of adapter 96 being fully threaded into conduit 92, a portion of slot 116 is aligned with hole 104 and tabs 112 are the only portion of adapter 96 that extend past the end of conduit 92. Therefore, adapter 96 is entirely located within conduit 92 when used and does not extend the overall length of conduit 92. Clamp 122 is passed over conduit 92 and is positioned so that internal threads 128 running through clamp 122 are lined up with hole 104 in conduit 92 and slot 116 in adapter 96. Preferably, stops 132 are locate along the circumference of conduit 92 to help position clamp 122 in the proper location. Conduit 92 is then placed over wall pipe 56 so that smooth bore 114 on adapter 96 is placed in contact with and slides over smooth outer surface 82 on wall pipe 56 and is secured in place using setscrew 106. Setscrew 106 engages internal threads 128 that run through clamp 122, passes through hole 130 in conduit 92, and slot 116 in adapter 96 to frictionally engage smooth outer surface 82 on wall pipe 56, thereby securing conduit 92 to wall pipe 56. Conduit 92 can be adjusted along the length of wall pipe 56 to help insure that bath spout shell 28 is mounted flush against wall 36 by loosening setscrew 106 and sliding conduit 92 along wall pipe 56 until the desired position is reached.

The above descriptions of certain embodiments are made for the purposes of illustration only and are not intended to be limiting in any manner. Other alterations and modifications of the preferred embodiment will become apparent to those of ordinary skill in the art upon reading this disclosure, and it is intended that the scope of the invention disclosed herein be limited only by the broadest interpretation of the appended claims to which the inventor is legally entitled.

What is claimed is:

1. A bath spout connection kit for connecting a bath spout shell to a threaded or smooth surfaced wall pipe having a diameter and extending beyond a wall, the kit comprising:

a conduit having a length and first and second threaded ends, said first end adapted to couple said conduit to the bath spout shell;

a first adapter having a length and first and second ends, said first end adapted to threadedly couple said adapter to said first conduit, said second end adapted to couple said first adapter to the pipe, such that said conduit length for use with threaded pipe is the same as the conduit length for use with smooth surfaced pipe and the bath spout shell mounts flush against the wall.

2. The kit of claim 1 wherein said first adapter has an interior surface at said second end and an exterior surface at said first end, said exterior surface having threads to couple said first adapter to said second end of said conduit and said interior surface having a smooth bore and adapted to couple said first adapter to the smooth surfaced pipe.

3. The kit of claim 2 further comprising a setscrew for coupling said first adapter to the pipe.

4. The kit of claim 3 further comprising a clamp surrounding said conduit to assist in securing said conduit to said pipe.

5. The kit of claim 1 wherein said second end of said conduit is adapted to couple to the threaded pipe where the diameter of the threaded pipe is a first size, said first adapter fits entirely within said conduit when coupled to said conduit, and said second end of said first adapter is adapted to couple said first adapter to a smooth surfaced pipe.

6. The kit of claim 5 further comprising a second adapter having first and second threaded ends, said first end adapted to couple said second adapter to said second threaded end of said conduit and said second end adapted to couple said adapter to the threaded pipe where the diameter of the pipe is a second size and wherein said second adapter fits entirely within said conduit when coupled to said conduit.

7. The kit of claim 1 further comprising a second adapter having first and second threaded ends, said first end adapted to couple said second adapter to said conduit and said second end adapted to couple said second adapter to the threaded pipe where the diameter of the pipe is a first size.

8. The kit of claim 7 wherein said second adapter has a length equal to said length of said first adapter.

9. The kit of claim 8 further comprising a third adapter having a length equal to said length of said first and second adapters and having a first and second threaded end, said first threaded end adapted to couple said third adapter to said second end of said conduit and said second end adapted to couple said second adapter to the threaded pipe where the diameter of the threaded pipe is a second size.

10. The kit of claim 7 wherein said first and said second adapters fit entirely within said conduit when coupled to said conduit.

11. The kit of claim 10 further comprising tabs on said second end of said first and second adapters.

12. The kit of claim 1 further comprising at least one additional conduit, wherein each said additional conduit has a length different from said length of said conduit.

13. The kit of claim 1 wherein said conduit comprises a first conduit segment having first and second threaded ends and a length and a second conduit segment having first and second threaded ends and a length, wherein said first end of said second conduit segment is adapted to threadedly couple to said second end of said first conduit segment to form said conduit.

14. The kit of claim 13 further comprising a third conduit segment having first and second threaded ends and a length shorter than said length of said second conduit segment, wherein said first end is adapted to threadedly couple to said second end of said first conduit segment to form said conduit.

15. The kit of claim 1 further comprising a groove in said conduit and a sealing member seated in said groove, said sealing member adapted to be in sealing contact with said adapter coupled to said conduit.

16. The kit of claim 1 further comprising a groove in said first adapter and a sealing member seated in said groove, said sealing member adapted to be in sealing contact with the smooth surfaced wall pipe.

17. The kit of claim 1 further comprising a bath spout shell.

18. The kit of claim 1 wherein said kit is made of polymeric material.

19. The kit of claim 1 wherein said kit is made of a metallic material.

20. A bath spout connection kit for connecting a bath spout shell to a threaded or smooth surfaced pipe having a diameter and extending beyond a wall, said kit comprising:

a first conduit having a length and first and second threaded ends, said first end adapted to threadedly couple to the bath spout shell;

a first adapter having a length and first and second threaded ends, said first end being adapted to couple said first adapter to said second end of said conduit and said second end of said first adapter being adapted to couple said first adapter to the threaded pipe where the diameter of the threaded pipe is a first size;

a second adapter having a length equal to said first adapter and having first and second ends, said first end being adapted to threadedly couple said second adapter to said second end of said conduit and said second end of said second adapter being adapted to couple said second adapter to the smooth surfaced pipe.

21. The kit of claim 20 further comprising a third adapter having a length equal to said first and said second adapters and having first and second threaded ends, said first end being adapted to couple said third adapter to said second end of said conduit and said second end of said third adapter being adapted to couple said third adapter to the threaded pipe where the diameter of the threaded pipe is a second size.

22. The kit of claim 20 further comprising a hole in said second adapter and a setscrew, wherein said setscrew is adapted to thread through said hole and engage said smooth surfaced pipe.

23. The kit of claim 20 wherein said conduit comprises:

a first conduit segment having first and second threaded ends, said first end adapted to threadedly couple said first conduit segment to said bath spout shell; and a second conduit segment having a length and first and second threaded ends, said first end adapted to couple said second conduit segment to said second end of said first conduit segment.

24. The kit of claim 22 further comprising a third conduit segment having a length shorter than said second conduit segment and having first and second threaded ends, said first end adapted to couple said third conduit segment to said second end of said first conduit segment.

25. The kit of claim 22 further comprising a third adapter having a length equal to said first and said second adapters and having first and second threaded ends, said first end being adapted to couple said third adapter to said second end of said conduit and said second end of said third adapter being adapted to couple said third adapter to the threaded pipe where the diameter of the threaded pipe is a second size.

26. The kit of claim 22 further comprising a hole in said second adapter and a setscrew, wherein said setscrew is adapted to thread through said hole and engage said smooth surfaced pipe.

27. The kit of claim 20 further comprising a groove proximate to said second end of said conduit and a sealing member seated in said groove, wherein said sealing member is adapted to be in sealing contact with said adapter when coupled to said conduit.

28. The bath spout connection kit of claim 27 wherein said sealing member is a O-ring.

29. The kit of claim 20 further comprising an additional conduit having a length shorter than said length of said first conduit and having a first and second threaded ends, said first end adapted to couple said additional conduit to the bath spout shell.

30. A bath spout connection kit for connecting a bath spout shell to a pipe having an end and a diameter and extending beyond a wall, said kit comprising:

a conduit having a length and having first and second threaded ends, said first end adapted to couple said conduit to the bath spout shell;

a first adapter having first and second ends, said first end adapted to threadedly couple said first adapter to said second end of said conduit and said second end having a smooth bore adapted to engage the end of the pipe where the end has a smooth surface;

wherein said first adapter is disposed entirely within said conduit when coupled to said conduit.

31. The kit of claim 30 further comprising tabs on said second end of said first adapter.

32. The kit of claim 30 further comprising a second adapter having first and second threaded ends, said first end adapted to couple said second adapter to said second end of said conduit, said second end adapted to couple said second adapter to the end of the pipe where the end is threaded and the diameter of the pipe is a first size and wherein said second adapter is disposed entirely within said conduit when coupled to said conduit.

33. The kit of claim 32 further comprising tabs on said second end of said second adapter.

34. The kit of claim 32 wherein said second end of said conduit is adapted to couple said conduit to the end of the pipe where the end is threaded and the diameter of the pipe is a second size.

35. The kit of claim 30 further comprising a slot in said first adapter, a hole proximate to said second end of said conduit, and a setscrew, wherein said setscrew is adapted to be received in said hole and said slot and engage the end of the pipe where the end has a smooth surface.

36. The kit of claim 35 wherein said conduit has a recess proximate to said second end that can be punched through to form said hole when said first adapter is used.

37. The kit of claim 35 further comprising a second conduit without said recess.

38. The kit of claim 37 wherein said first adapter is secured in said conduit with said slot aligned with said hole.

39. The kit of claim 35 further comprising a clamp surrounding said conduit and adapted to assist in securing said conduit to the end of the pipe.

40. The kit of claim 39 further comprising at least one stop on said conduit to position said clamp.

41. The kit of claim 39 wherein said clamp includes a threaded hole and wherein said setscrew engages said threaded hole.

42. The kit of claim 30 further comprising at least one additional conduit having a length different from said length of said conduit.

43. The kit of claim 30 wherein said first adapter further comprises a groove and a sealing member seated in said groove, wherein said sealing member is adapted to be in sealing contact with said conduit and the smooth surface on the pipe.

44. The kit of claim 43 wherein said sealing member is an O-ring.

45. The kit of claim 30 further comprising fins on said second end of said conduit.

46. A bath spout connection kit for connecting a bath spout shell to a threaded or smooth surfaced pipe having a diameter and extending beyond a wall, said kit comprising:

a conduit having a length and having first and second threaded ends, said first end adapted to couple said conduit to the bath spout shell and said second end of said conduit adapted to couple said conduit to a threaded pipe where the diameter of the threaded pipe is a first size;

a first adapter having first and second ends, an exterior surface on said first end, said exterior surface adapted to threadedly couple said first adapter to said second end of said conduit and an interior surface on said second end, said interior surface having a smooth bore adapted to engage said smooth surfaced pipe;

a circumferential groove in said first end of said first adapter;

a sealing member seated in said circumferential groove, said sealing member adapted to be in sealing contact with said conduit and said smooth surfaced pipe;

a recess proximate to said second end of said conduit that can be punched through to form a hole when said first adapter is used;

a slot in said first adapter that aligns with said hole when said first adapter is coupled to said second end of said conduit;

a clamp adapted to surround said conduit having a threaded hole;

a setscrew adapted to thread through said threaded hole, be received in said hole in said conduit and said slot in said first adapter and engage said smooth surfaced pipe;

a second adapter having an first and second end, an exterior threaded surface on said first end, said exterior surface adapted to couple said second adapter to said second end of said conduit, and an interior threaded surface on said second end, said interior surface adapted to couple said second adapter to a threaded pipe where the diameter of the threaded pipe is a second size;

wherein said adapters are disposed entirely within said conduit when coupled to said conduit.

47. The kit of claim 46 further comprising at least one stop on said conduit to position said clamp.

48. The kit of claim 46 further comprising at least one additional conduit having a length different from the length of said conduit.

49. The kit of claim 46 further comprising fins on said second end of said inner conduit.

* * * * *